US005605437A

United States Patent [19]

Meylan

[11] Patent Number: 5,605,437

[45] Date of Patent: Feb. 25, 1997

[54] COMPRESSOR AND METHOD OF OPERATING IT

[75] Inventor: Pierre Meylan, Neuenhof, Switzerland

[73] Assignee: ABB Management AG, Baden, Switzerland

[21] Appl. No.: 253,985

[22] Filed: Jun. 3, 1994

[30] Foreign Application Priority Data

Aug. 14, 1993 [DE] Germany ..... 43 27 376.9

[51] Int. Cl.[6] ..... F01D 25/10; F01D 11/14

[52] U.S. Cl. ..... 415/175; 415/1; 415/134; 415/173.2

[58] Field of Search ..... 415/175, 47, 48, 415/134, 1, 115, 176–178, 173.2, 173.3

[56] References Cited

U.S. PATENT DOCUMENTS

| | | | |
|---|---|---|---|
| 2,655,308 | 10/1953 | Luttman | 415/177 |
| 4,230,436 | 10/1980 | Davison . | |
| 4,386,885 | 6/1983 | Beckershoff | 415/178 |
| 4,721,433 | 1/1988 | Piendel et al. | 415/115 |
| 4,849,895 | 7/1989 | Kervistin . | |
| 5,219,268 | 6/1993 | Johnson | 415/115 |

FOREIGN PATENT DOCUMENTS

| | | | |
|---|---|---|---|
| 0140818B1 | 5/1985 | European Pat. Off. . | |
| 3909606A1 | 10/1989 | Germany . | |
| 0247001 | 12/1985 | Japan | 415/177 |
| 2103718 | 2/1983 | United Kingdom | 415/178 |

OTHER PUBLICATIONS

"Thermal Response Turbine Shroud Study", E. J. Kawecki, Technical Report, Jul. 1979.

*Primary Examiner*—Edward K. Look
*Assistant Examiner*—Christopher Verdier
*Attorney, Agent, or Firm*—Burns, Doane, Swecker & Mathis

[57] ABSTRACT

In a compressor (1), in particular for a gas turbine, which compressor includes a rotor (3), which is rotatably supported about a compressor center line and possesses at its periphery a plurality of rotor blades (5*a–d*), and a compressor casing (2), which concentrically surrounds the rotor (3), a radial clearance being provided between the outer ends of the rotor blades (5*a–d*) and the inner wall of the compressor casing (2), the possibility of a warm start without sacrificing efficiency is achieved by configuring the compressor casing (2) so that it can be heated in order to reduce the fluctuations in the radial clearance and by connecting it to a separate heating appliance (22, 25, 27), which is independent of the operation of the compressor and by means of which the compressor casing can be heated in the case of a warm start.

13 Claims, 5 Drawing Sheets

COMPRESSOR AND METHOD OF OPERATING IT

FIELD OF THE INVENTION

The present invention relates to the field of turbomachines. It concerns a compressor, in particular for a gas turbine, which compressor includes a rotor, which is rotatably supported about a compressor center line and possesses at its periphery a plurality of rotor blades, and a compressor casing, which concentrically surrounds the rotor, a radial clearance being provided between the outer ends of the rotor blades and the inner wall of the compressor casing. The invention also concerns a method for operating such a compressor.

A compressor of the type mentioned is known, for example, from the publication DE-A1-39 09 606.

DISCUSSION OF BACKGROUND

In rotating compressors, and also particularly in high-pressure compressors such as are used, for example, in stationary gas turbines or turbine driving systems for the compression of combustion air, rings of rotor blades are arranged one behind the other in several pressure stages on a rotor shaft and are concentrically surrounded by a compressor casing. A radial clearance of the order of value of 1 mm is provided between the outer ends of the rotor blades and the inner wall of the compressor casing. This clearance should be kept as small as possible in order to restrict the reverse flow of air and the associated reduction in efficiency. The same applies to the rings of guide vanes which are arranged between the pressure stages and are fastened to the inner wall of the compressor casing.

The reduction in the radial clearance is made more difficult by the fact that the compressor rotor blades and the compressor casing expand and contract to different extents in the different operating conditions. The radial clearance must therefore be selected in such a way that it is still sufficient under the most unfavorable operating conditions, i.e. with an expanded rotor and rotor blades and a contracted compressor casing. Account should be taken of the fact that the change in the radial clearance can have both mechanical and thermal causes. The main mechanical cause to be considered is the radial deflection of the rotor and the rotor blades due to the centrifugal forces acting during rapid rotation. Different thermal expansions in the rotor and stator due to temperature differences or different expansion coefficients of the materials used may be regarded as the thermal causes.

A large number of proposals has been made in the past concerning active correction of the radial clearance (so called "active clearance control") during operation. In the publication mentioned at the beginning, for example, optional colder and/or warmer compressed air originating from different compressor stages is, for this purpose, directed into the rotor in order to control the radial clearance by controlling the temperature of the disks supporting the rotor blades. A comparable solution is also published in EP-B1-0 140 818. Special methods for the open-chain and closed-loop control of the clearance can, for example, be taken from U.S. Pat. No. 4,849,895.

In addition to the rotor temperature control system mentioned above, a compressor casing temperature control system has also been previously proposed (U.S. Pat. No. 4,230,436). In this system, the temperature of the compressor casing is lowered in a controlled manner by a cooling airflow of greater or lesser strength. The cooling air is taken from different compressor stages and is fed along cooling passages both behind the guide vanes and behind the inner wall of the compressor casing opposite to the rotor blades.

The known methods of active clearance control relate to normal operation of the compressor. They can therefore make use of compressor air of varying temperature or—in the case of the compressor of a gas turbine—of hot gas from the driving system part for cooling or heating different compressor parts or compressor sections.

The so-called "warm start" case is not allowed for in these arrangements. In a warm start, the compressor is started again after being previously shut down but before it has completely cooled. In this case, the rotor and the stator are at markedly different temperatures because the outer stator cools more rapidly and correspondingly contracts whereas the rotor remains hot longer and correspondingly retains its expansion. Because of this, the radial clearance is substantially reduced. In order to make renewed starting possible in this condition (warm start), this special case must be taken into account in the design of the radial clearance and this leads to increased radial clearance figures.

SUMMARY OF THE INVENTION

Accordingly, one object of this invention is to provide a novel compressor which is suitable for a warm start without making the radial clearance worse and to provide a method of operating such a compressor.

The object is achieved in a compressor of the type mentioned at the beginning wherein the compressor casing is configured so that it can be heated in order to reduce the fluctuations in the radial clearance and is connected to a separate heating appliance, which is independent of the operation of the compressor and by means of which the compressor casing can be heated in the case of a warm start.

The core of the invention consists in providing a heating appliance which operates independently of the operation of the compressor and which can heat the compressor casing before a warm start to such an extent that practically no reduction in the radial clearance due to a temperature drop between the rotor and the stator now appears.

The compressor according to the invention has a preferred embodiment wherein a plurality of peripheral heating passages, which are arranged one behind the other in the direction of the compressor center line and through which a heated heating medium can be dispatched in a circulating manner, are provided in the compressor casing, wherein the compressor casing is occupied on its inner periphery by a plurality of guide vanes, wherein turned vane recesses are provided on the inner periphery of the compressor casing to accommodate the guide vanes which are pushed into the turned vane recesses by means of corresponding vane roots and wherein the heating passages are respectively, formed by grooves which are let into the bottoms of the turned vane recesses. This permits a particularly simple and operationally reliable heating system to be achieved in which only trivial modifications to the compressor casing have to be undertaken.

The invention has a second preferred embodiment wherein a plurality, preferably three, heating passages are respectively connected one behind the other in a row, wherein the heating medium flows through this row against the flow direction of the compressor, wherein each heating passage forms per sea circular ring and, in the case of heating passages connected in series, the adjacent individual heating passages are connected to one another by transfer passages extending parallel to the compressor center line. This permits the achievement of effective and uniform heating with a simultaneously minimized number of external connections.

In a third preferred embodiment, compressed air is used as the heating medium, the heating appliance includes a compressed air connection from which a compressed air supply conduit leads via a heating system to the compressor casing and the heating system is configured as an electrical heating system (the heating can also take place by means of a gas burner).

In order to prepare for a warm start in the method according to the invention, the compressor casing is heated after the compressor is shut down and the heating is only ended when the compressor, after the warm start, has attained a certain proportion, preferably between approximately 75% and 100%, of its full load. This ensures that external heating power is only supplied to the casing until such time as the operationally conditioned balance between the temperatures of the rotor and the stator has been achieved.

The method according to the invention has a preferred embodiment wherein, in order to heat the compressor casing, compressed air is heated and forced through heating passages extending in the compressor casing and wherein, during a warm start of the compressor, externally compressed air is initially supplied and, after a specified working pressure in the compressor has been reached, the supply of externally compressed air is interrupted and, in its place, compressed air from the outlet of the compressor is branched off and used.

Further embodiments are given by the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
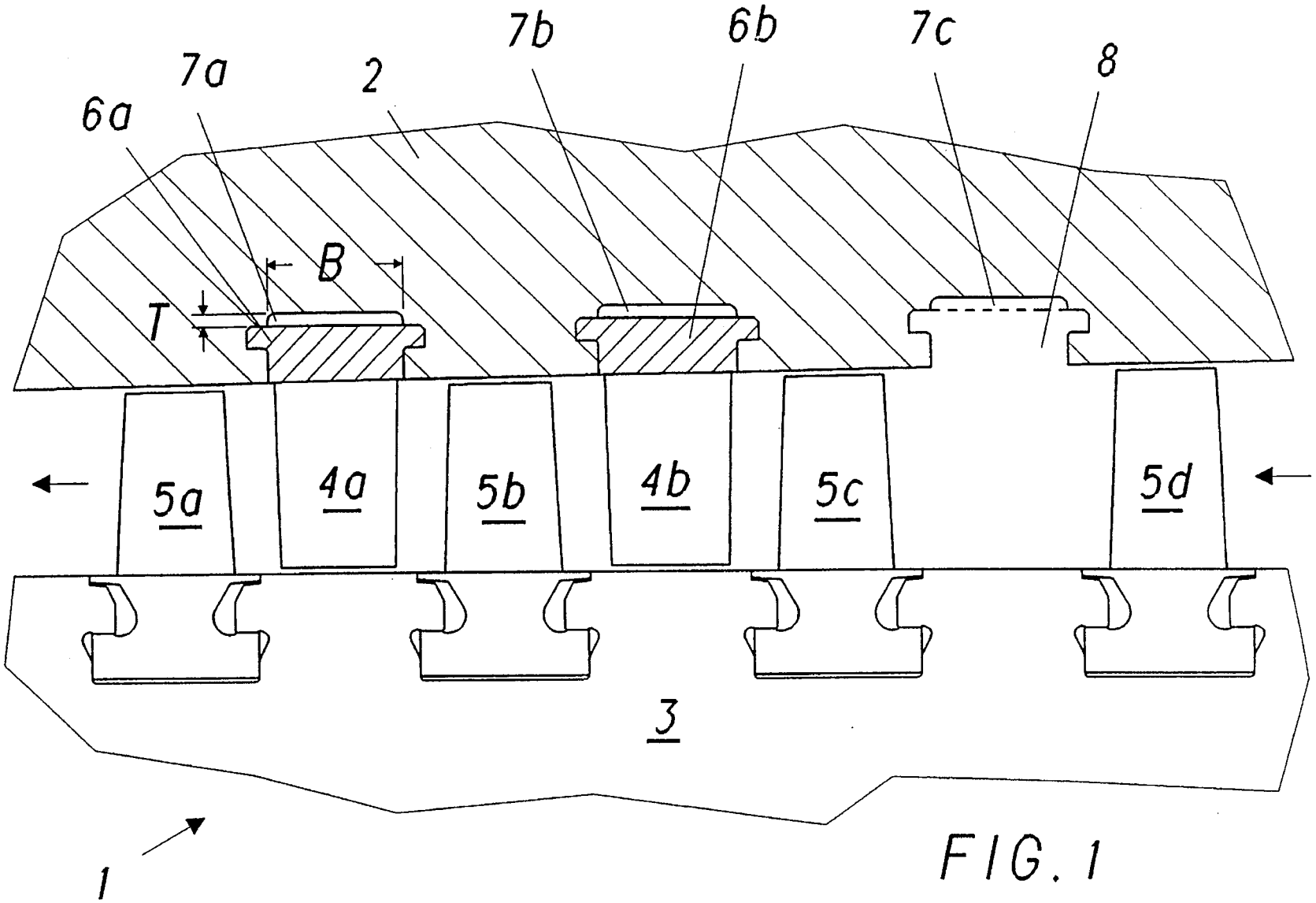
FIG. 1 shows, in longitudinal section along the rotor center line, an excerpt from a compressor in accordance with a preferred embodiment example of the invention with heating passages arranged under the guide vanes in the compressor casing.

Referring now to the drawings, wherein like reference numerals designate identical or corresponding parts throughout the several views, a preferred embodiment example of a compressor in accordance with the invention is shown in FIG. 1, in longitudinal section along the rotor center line. The compressor 1 includes a rotor 3 and a compressor casing 2 concentrically surrounding the rotor 3. A plurality of rotor blade rings are arranged on the rotor 3 one behind the other along the rotor center line. These rotor blade rings each have, in turn, a plurality of rotor blades 5*a–d*. The rotor blades are fastened to the rotor 3 by means of appropriate blade roots (for simplicity, the hatching on the rotor necessary because of the sectioning has been omitted). Each of the rotor blade rings forms its own compressor stage. Guide vane rings are arranged between the individual rotor blade rings and their individual guide vanes 4*a, b* are fastened by corresponding vane roots 6*a, b* in turned vane recesses 8 on the compressor casing 2 (as the vane carrier). (For ease of viewing, the right-hand guide vane ring is omitted from the turned vane recesses 8.)

Provision is made between the outer ends of the rotor blades 5*a–d* and the inside of the compressor casing 2 and also between the inner ends of the guide vanes 4*a, b* and the outer surface of the rotor 3 for a radial clearance which is selected in such a way that, on the one hand, rubbing of the ends of the blades on the opposite wall is reliably avoided in every operating condition and that, on the other hand, the efficiency of the compressor is not unnecessarily reduced by the resulting gap.

The medium to be compressed (for example the combustion air of a turbine) flows from right to left, in the representation, through the blading rings between the rotor 3 and the compressor casing 2; it is compressed in the process and increasingly heated. Part of the resulting compression heat is given up to the rotor 3, the compressor casing 2 and the blading 5*a–d* and 4*a,b*. A temperature profile therefore appears in the compressor during operation and this profile increases from the right to the left along the rotor center line whereas the temperature differences in the radial direction between the rotor 3 and the compressor casing are comparatively slight. Because the rotor and the compressor casing are heated and cooled to the same extent in normal operation, the fluctuations in the radial clearance are relatively limited.

This, however, changes in the case of a so-called warm start. In the case of a warm start, the compressor has no opportunity to cool completely after being previously shut down because it is started a relatively short period after the shut-down. In this case, the outer compressor casing 2 has cooled more rapidly than the inner rotor. The varying amount of contraction caused by this causes a marked reduction in the radial clearance and this makes additional measures necessary. Although this special feature can, fundamentally, be taken into account by increasing the clearance selected, this increase leads to a deterioration in efficiency during normal operation.

Instead of this, the present invention provides for the compressor casing to be heated in the case of a warm start in such a way that compensation is provided for the excessive cooling and it is not therefore necessary to take any account of the warm start case in the selection of the radial clearance. For this purpose, heating passages 7*a–c* are provided in the compressor casing 2 in the embodiment example of FIG. 1. A heated heating medium, in particular steam or compressed air, can be forced to circulate under pressure through these heating passages 7*a–c*. The use of steam may be particularly considered if (i) there is a source of steam present, (ii) the temperature of the metal is less than 600° C., and (iii) the temperature of the steam is greater than that of the compressor air. The heating passages 7*a–c* are simply configured as annular peripheral grooves in the bottoms of the turned vane recesses 8 and can therefore be immediately manufactured during the manufacture of the turned vane recesses 8.

Figure 2:
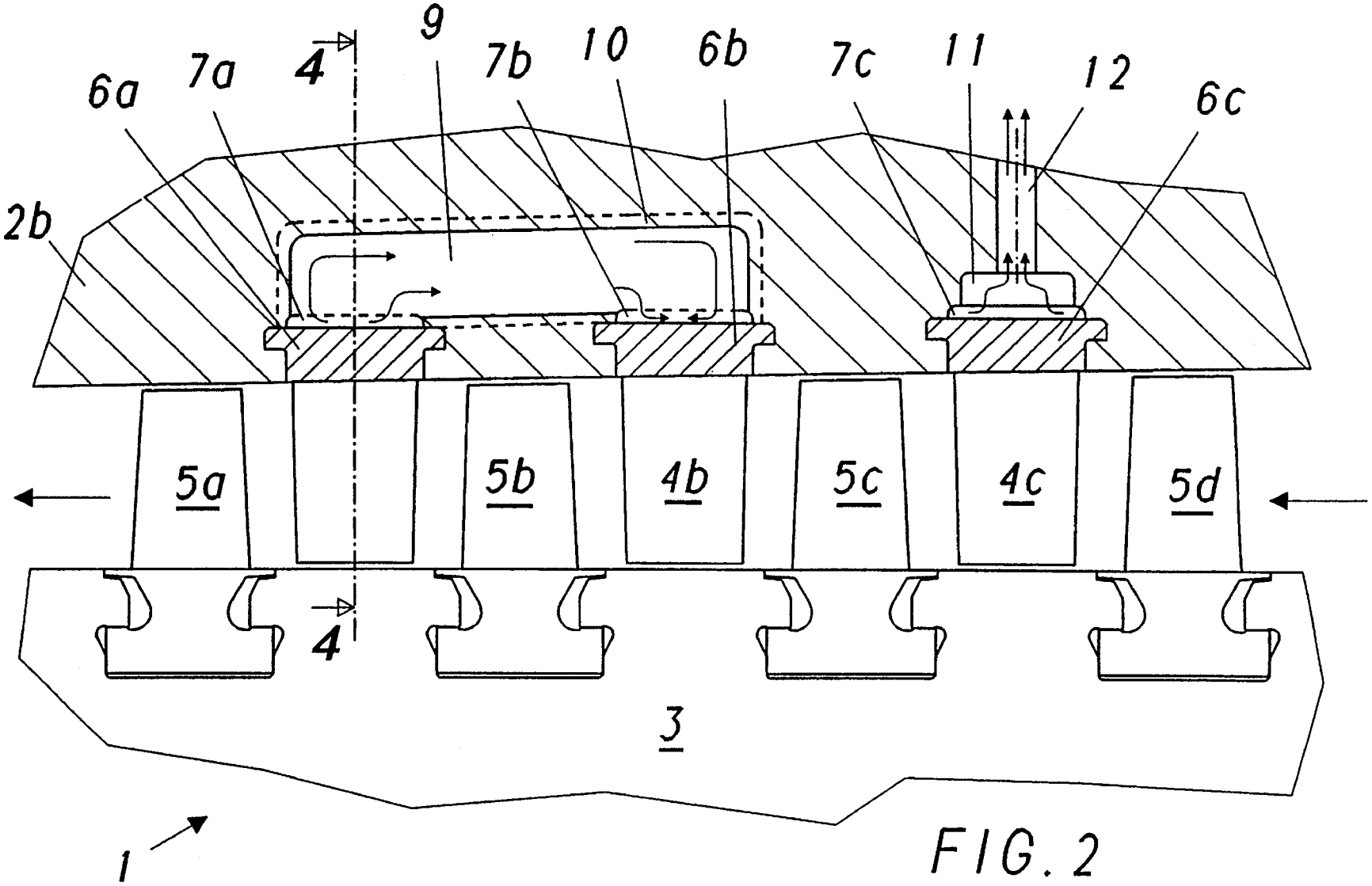
FIG. 2 shows a representation corresponding to FIG. 1, with a section in the plane Z—Z of FIG. 4, with a first transfer passage, which connects two adjacent heating passages, and an outlet passage.
Figure 3:
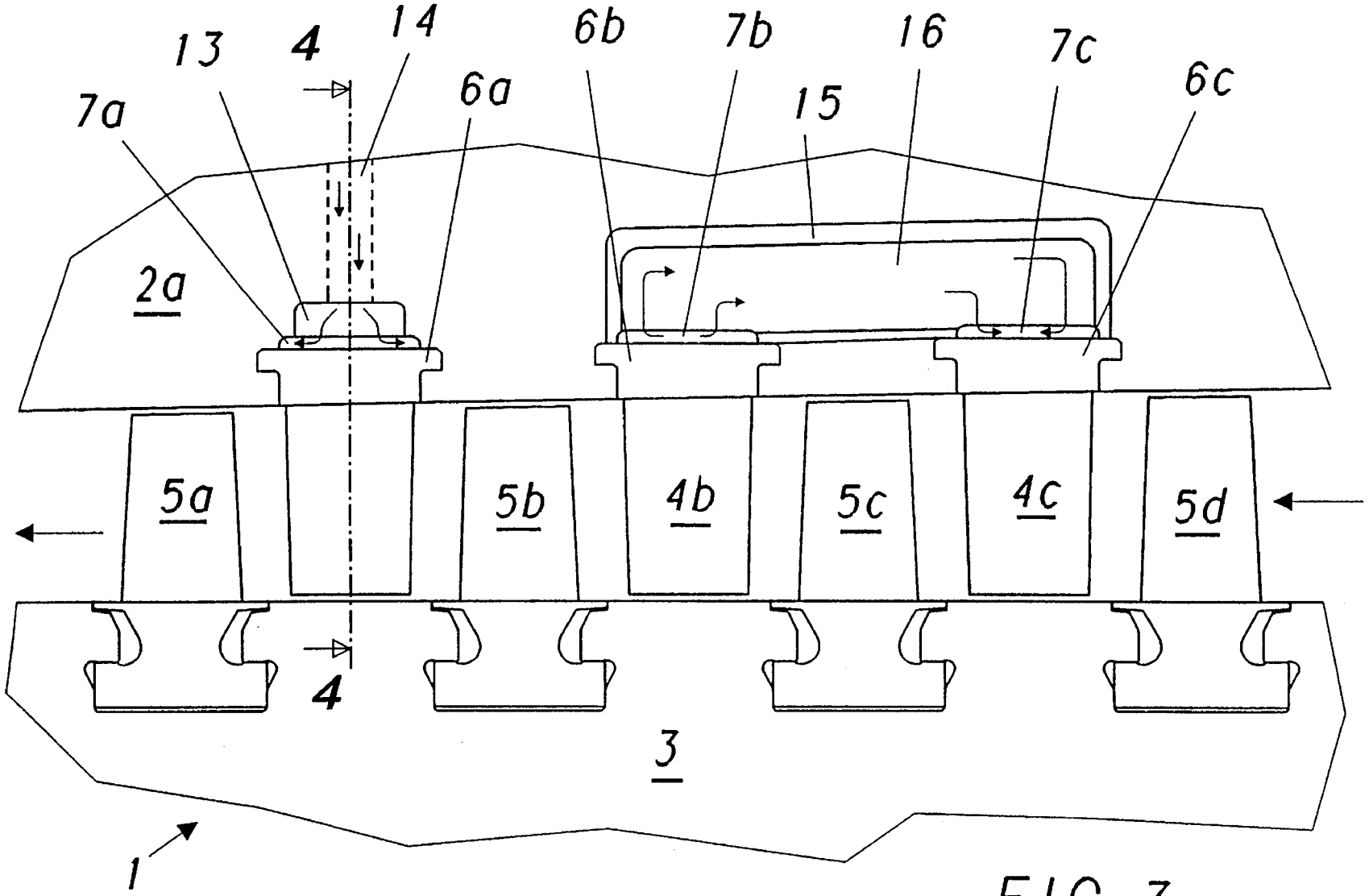
FIG. 3 shows a representation corresponding to FIG. 1 with a section along the split plane (18) from FIG. 4 with a second transfer passage and an outlet passage.

A plurality, preferably three, of the heating passages 7*a–c* are respectively connected one behind the other in a row and the heating medium flows through them against the flow direction of the compressor 1, i.e. from left to right in the representation shown in FIG. 1 to 3. Because of the series connection, there is an axial temperature drop which corresponds approximately to the temperature drop occurring in the compressor during operation. In order to make the temperature distribution transverse to the compressor center line homogeneous and prevent bending of the vane carrier, the heating medium is preferably guided with alternating peripheral directions in adjacent heating passages (see FIG. 6). The series connection can, fundamentally, be achieved by appropriate external connection between the individual adjacent heating passages. As part of the invention, however, an internal series connection is preferred and can be explained using FIG. 2 to 4 (a parallel connection is likewise conceivable depending, specifically, on the pressure difference Δp).

Figure 4:
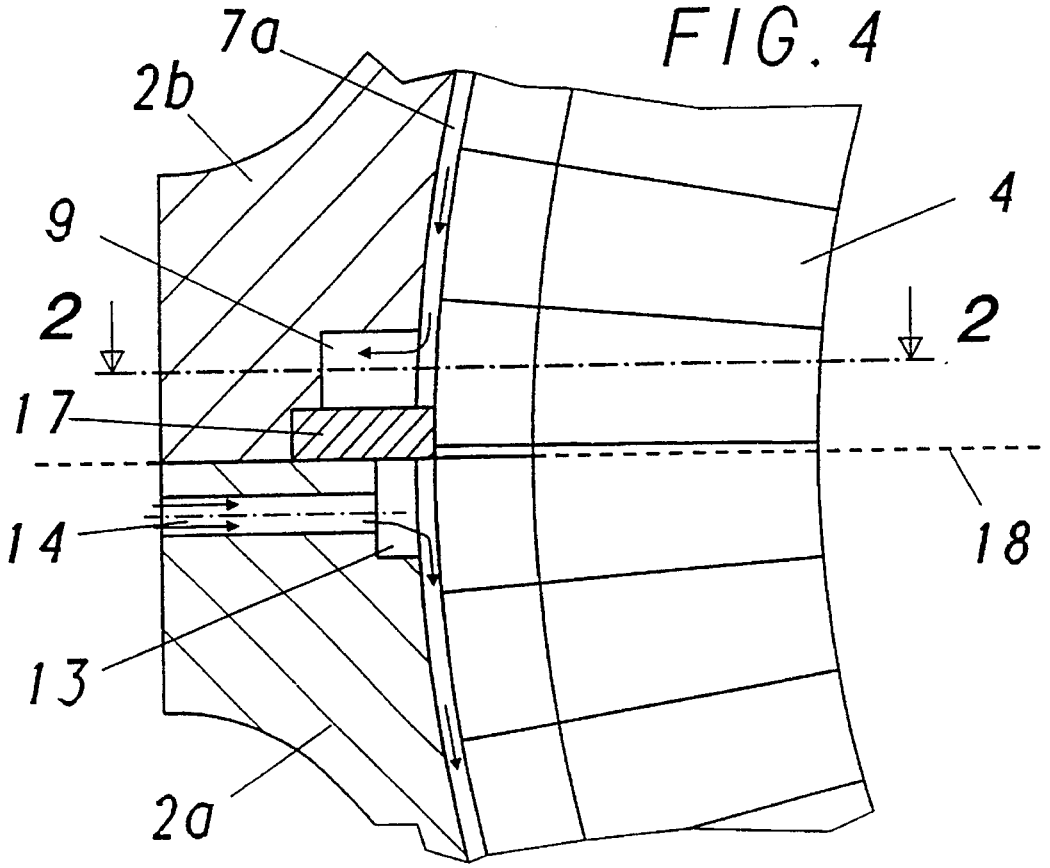
FIG. 4 shows a cross-section along the planes X—X of FIG. 2 (casing upper part 2*b*) and along the plane Y—Y of FIG. 3 (casing lower part 2*a*)

The preferred internal series connection of the heating passages 7*a–c* makes use of the fact that the compressor casing 2 is generally divided along a split plane 18 into two halves, a casing upper part 2*b* and a casing lower part 2*a* (FIG. 4). Starting from the split plane 18, transfer passages 9, 16 are respectively milled in the center line direction, alternately in the casing upper part 2*b* and the casing lower part 2*a*. These transfer passages 9, 16 respectively connect together two adjacent heating passages (in FIG. 2, the heating passages 7*a* and 7*b* and, in FIG. 3, the heating passages 7*b* and 7*c*). If there are three heating passages 7*a–c* connected in series, a total of two transfer passages (9 and 16) is necessary. FIG. 2 shows the section through the casing upper part 2*b* along the plane Z—Z of FIG. 4; the transfer passage 9 is correspondingly sectioned. FIG. 3 shows the plan view onto the casing lower part 2*a* from the split plane 18; the transfer passage 16 can be correspondingly seen in plan view.

The transfer passage 9 (and also the transfer passage 16) is closed off towards the split plane 18 by a separating plate 17 (FIG. 4). The separating plate 17 is wider and longer than the associated transfer passage and rests on a step surrounding the passage (10 in the case of the transfer passage 9 in FIG. 2 and 15 in the case of the transfer passage 16 in FIG. 3). The separating plate 17 reaches towards the compressor center line as far as the turned vane recesses 8 and, by this means, simultaneously interrupts the two heating passages 7*a*, 7*b*, which are connected by the associated transfer passage 9, at the split plane 18. This interruption is necessary in order to permit a certain flow direction of the heating medium to be fixed in the respective heating passage. The two transfer passages 9, 16 overlap in the region of the central heating passage 7*b* but are there separated from one another by the two separating plates.

Figure 6:
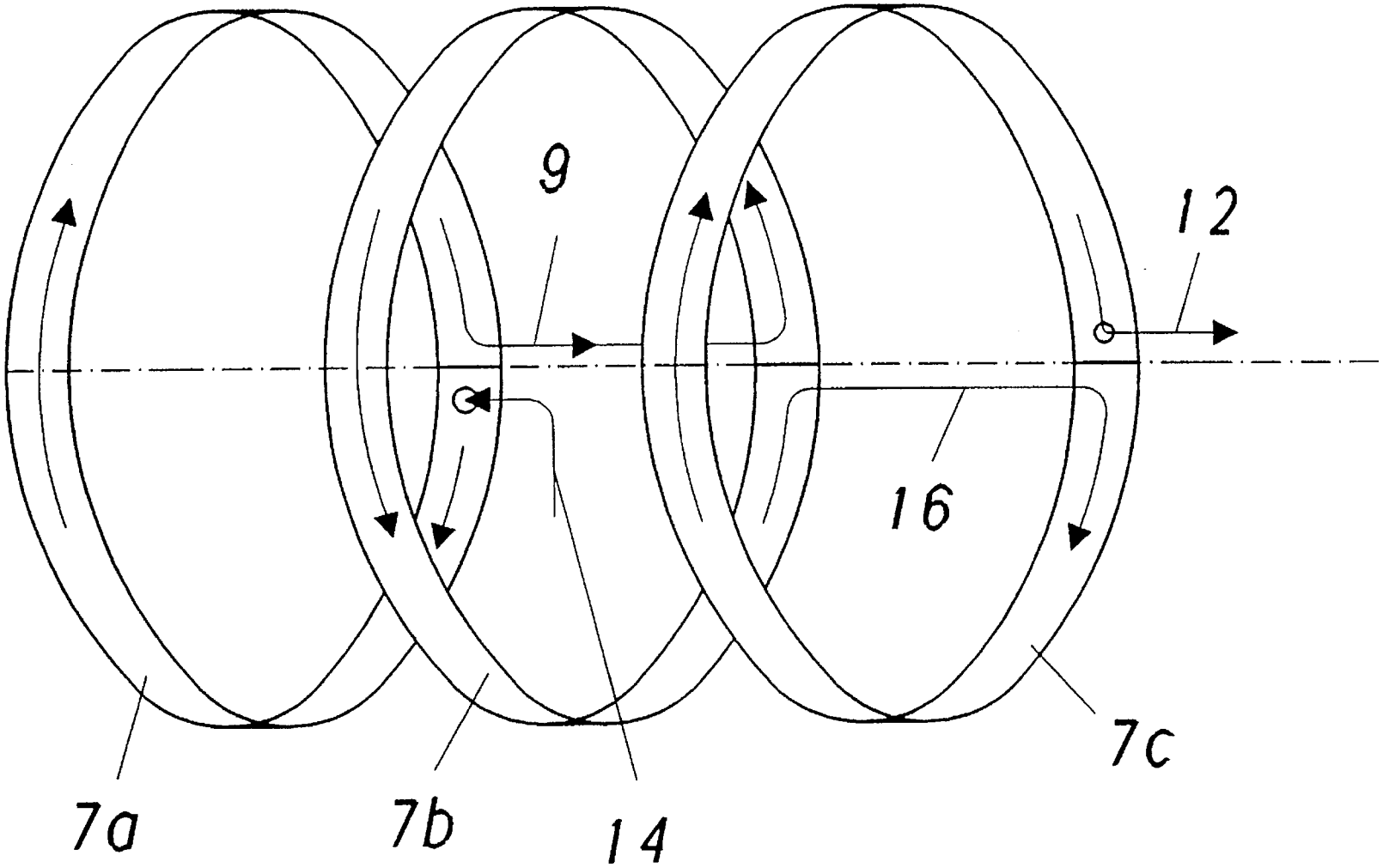
FIG. 6 shows, diagrammatically, the flow path of the heating medium in the heating configuration of FIG. 2 and 3.

In the case of the three heating passages 7*a–c* connected in series and represented in the Figures, the heating medium is fed through an inlet passage 14 and an inlet space 13 (FIG. 2) into the heating passage 7*a* located furthest downstream. The inlet passage 14 opens into the heating passage on the side of the separating plate 17 opposite to the transfer passage 9 (FIG. 4). In the first heating passage 7*a*, the heating medium passes once around the compressor center line in a first rotational direction and then reaches the central heating passage 7*b* via the first transfer passage 9; it there passes around the compressor center line for a second time in an opposite rotational direction and then reaches the third heating passage 7*c* via the second transfer passage 16; it there passes around the compressor center line for a third time, again in a changed direction of rotation, and finally emerges to the outside again via an outlet space 11 and outlet passage 12 connected to the heating passage 7*c* (FIG. 2 and 6). This flow path of the heating medium through the three heating passages 7*a–c* connected in series by means of the transfer passages 9, 16 is reproduced again, for emphasis, in the diagrammatic perspective representation of FIG. 6. Although in the preferred embodiment example presented here, the heating passages are respectively connected in series in groups of three passages, it is self-evident that the connection of different heating passages in a different manner can also be carried out within the framework of the invention.

Figure 5:
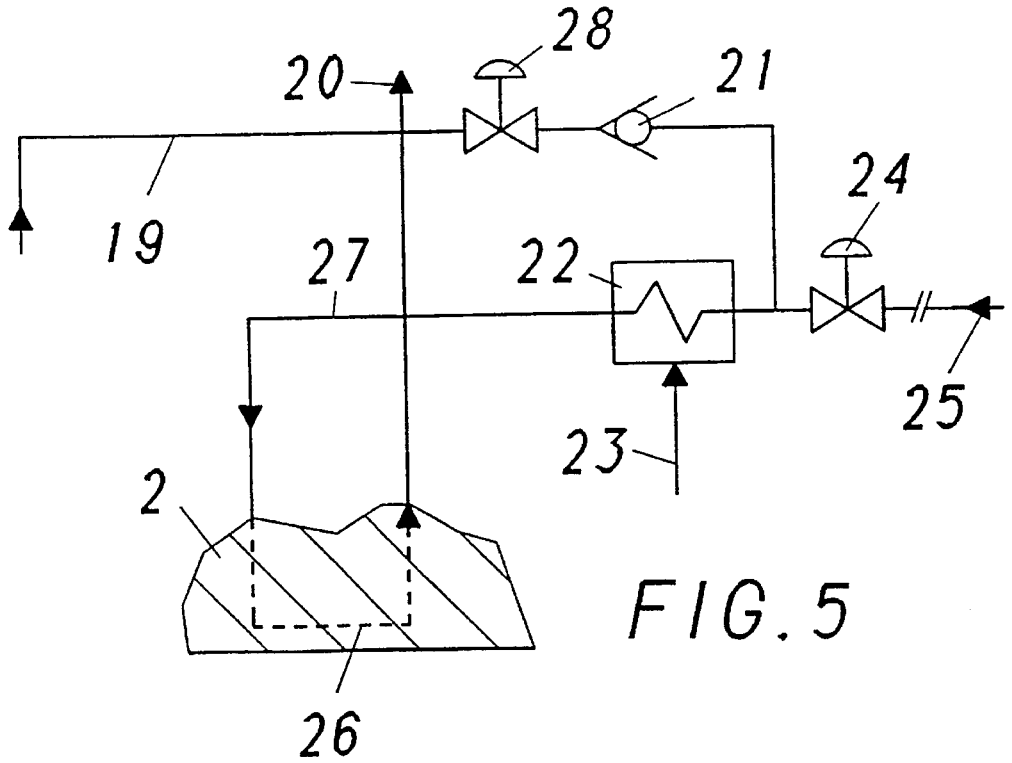
FIG. 5 shows a diagram for a preferred embodiment example of a heating device for the compressor in accordance with the invention.

Compressed air, in particular clean instrument air, is preferably used as the heating medium. The compressed air is transported, as shown in FIG. 5, via a compressed air connection 25 and a heating system 22 by means of a compressed air supply conduit 27 to the compressor casing 2. The heating system 22 is preferably a heat exchanger operating with gas (propane, butane or the like) or an electrical (resistance) heating system. The compressed air, at a pressure of approximately 0.6 MPa, is heated in the heating system 22 and is forced into the heating passages 26 as soon as the compressor 1 is shut down. The temperature of the pressure medium achieved by means of the heating system 22 is preferably selected to be between 50 and 100K above the metal temperature of the compressor during normal operation (i.e. approximately 600° C.). The heating system and the compressed air supply are switched off as soon as the compressor has reached a certain proportion of its full load, preferably approximately 75% to 100%. This can take place by means of a main valve 24 which is arranged between the compressed air connection 25 and the heating system 23. An auxiliary conduit 19 can also open into the compressed air supply conduit 27 between the main valve 24 and the heating system. This auxiliary conduit 19 contains a non-return valve 21 and can have compressor air admitted to it. The compressor air then takes the place of the externally supplied compressed air when the compressor, after starting, itself generates sufficient pressure to open the non-return valve 21. A valve 28, which is closed in-normal operation, is also provided in the auxiliary conduit 19 in order to avoid reverse flows.

For a preferred depth T of the heating passages 7*a–c* of a few millimeters, in particular 1 to 5 mm, a preferred width B of a few centimeters, in particular 20 to 40 mm, and an average periphery of, for example, 1.6 m, the pressures selected give a velocity of the air in the heating passages of between 100 and 250 m/s and a volume throughput of between 0.004 and 0.04 $m^3/s$. The heating power required for the heating system 22 and supplied by means of a heating system supply conduit 23 is of the order of value of between 50 and 200 kW. For an inlet pressure of 0.6 MPa, the pressure of the air at the outlet 20 (FIG. 5) is approximately 0.1 MPa.

Overall, the invention provides a compressor which is suitable for a warm start without sacrifices in terms of efficiency.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A compressor for a gas turbine, comprising:

a rotor rotatably supported about a compressor center line;

a plurality of rotor blades mounted at a periphery of the rotor;

a compressor casing, which concentrically surrounds the rotor, a radial clearance being provided between the outer ends of the rotor blades and the inner wall of the compressor casing, wherein the compressor casing includes a plurality of peripheral heating passages positioned in series parallel to the compressor center line for circulating a heated compressed air through the compressor casing to reduce temperature generated fluctuations in radial clearance between the casing and the blades; and a separate heating appliance connected to deliver heated compressed air to the peripheral heating passages, the heating appliance including a heating system, a compressed air connection to receive compressed air from a compressed air source, and a compressed air supply conduit to carry compressed air through the heating system to the compressor casing, the heating appliance being operable independently of the operation of the compressor.

2. The compressor as claimed in claim 1, wherein the heating system is configured as heat exchanger.

3. The compressor as claimed in claim 1, wherein the heating system is configured as an electrical heating system.

4. The compressor as claimed in claim 1, wherein a main valve is arranged between the compressed air connection and the heating system and wherein an auxiliary conduit equipped with a non-return valve is connected to the compressed air supply conduit between the main valve and the heating system, the auxiliary conduit connected to carry compressor air.

5. A method for operating a compressor for a warm start, which compressor includes a rotor rotatably supported about a compressor center line, a plurality of rotor blades mounted at a periphery of the rotor, and a compressor casing, which concentrically surrounds the rotor, a radial clearance being provided between the outer ends of the rotor blades and the inner wall of the compressor casing, the method comprising the step of heating the compressor casing after the compressor is shut down, wherein heating is only ended when the compressor, after the warm start, has attained between approximately 70% to 100% of a full load.

6. The method as claimed in claim 5, wherein heating the compressor casing comprises heating compressed air forcing the heated compressed air through heating passages extending in the compressor casing.

7. The method as claimed in claim 6, wherein the heated compressed air is forced through the heating passages with a pressure of approximately 0.6 MPa at a volume flow between 0.004 and 0.038 $m^3/s$.

8. The method as claimed in claim 6, wherein the compressed air is heated to a temperature of between 50 and 100K above the metal temperature of the compressor in normal operation.

9. The method as claims in claim 6, comprising the steps of supplying and heating externally compressed air and, after a predetermined working pressure in the compressor has been reached, interrupting the supply of externally compressed air and directing compressed air from an outlet of the compressor for heating and forcing through the heating passages.

10. The method as claimed in claim 5, wherein steam is used as the heating medium for heating the compressor casing.

11. A compressor for a gas turbine, comprising:

a rotor rotatably supported about a compressor center line;

a plurality of rotor blades mounted at a periphery of the rotor;

a compressor casing, which concentrically surrounds the rotor, a radial clearance being provided between the outer ends of the rotor blades and the inner wall of the compressor casing, wherein the compressor casing includes a plurality of peripheral heating passages connected in a row parallel to the compressor center line for circulating a heating medium through the compressor casing to reduce temperature generated fluctuations in the radial clearance, wherein each heating passage forms a ring-shaped passage in the compressor casing, adjacent heating passages being connected by transfer passages extending parallel to the compressor center line; and a separate heating appliance connected to deliver the heating medium to the peripheral heating passages, wherein the heating medium is directed to flow through the row of heating passages against a flow direction of the compressor, the heating appliance being operable independent of the operation of the compressor.

12. The compressor as claimed in claim 11, wherein the heating medium is guided in alternating peripheral directions relative to each heating passage.

13. The compressor as claimed in claim 12, wherein the compressor casing is subdivided along a split plane into a casing upper part and a casing lower part, wherein the heating passages are interrupted at the split plane and wherein the transfer passages alternately extend above and below the split plane.

* * * * *